US010633866B2

(12) United States Patent
Brenchley

(10) Patent No.: US 10,633,866 B2
(45) Date of Patent: Apr. 28, 2020

(54) SYSTEMS AND METHODS FOR DIVERTING FLUIDS

(71) Applicant: Philip Brenchley, Mountlake Terrace, WA (US)

(72) Inventor: Philip Brenchley, Mountlake Terrace, WA (US)

( * ) Notice: Subject to any disclaimer, the term of this patent is extended or adjusted under 35 U.S.C. 154(b) by 0 days.

(21) Appl. No.: 15/288,869

(22) Filed: Oct. 7, 2016

(65) Prior Publication Data

US 2017/0292263 A1 Oct. 12, 2017

Related U.S. Application Data

(63) Continuation of application No. 15/245,102, filed on Aug. 23, 2016, now abandoned.

(60) Provisional application No. 62/319,759, filed on Apr. 7, 2016.

(51) Int. Cl.

| | |
|---|---|
| ***E04D 13/02*** | (2006.01) |
| ***E04D 15/00*** | (2006.01) |
| ***E04B 1/68*** | (2006.01) |
| ***E04D 13/04*** | (2006.01) |
| *E04F 15/02* | (2006.01) |
| *E04D 13/12* | (2006.01) |
| *E04D 15/02* | (2006.01) |

(52) U.S. Cl.

CPC ..... *E04D 13/0481* (2013.01); *E04D 13/12* (2013.01); *E04D 15/00* (2013.01); *E04D 15/02* (2013.01); *E04F 15/02183* (2013.01)

(58) Field of Classification Search

CPC ..... E04D 13/12; E04D 1/26; E04D 15/00; E04D 15/02; E04B 1/6804; E04B 1/003; E04B 1/00; E04B 1/68; E04F 15/02183

USPC ..... 52/749.12, 749.11

See application file for complete search history.

(56) References Cited

U.S. PATENT DOCUMENTS 1,351,453 A * 8/1920 Wells, Jr. ..... E06B 3/44 292/343
1,430,981 A * 10/1922 Goldthwaite ..... A47G 27/0431 16/17.1
2,137,889 A * 11/1938 Gillett ..... E04D 13/1415 52/58
3,185,442 A * 5/1965 Hemphill ..... A01G 23/099 254/104
3,389,411 A * 6/1968 Emery ..... A47C 21/022 428/71
3,956,788 A * 5/1976 Nagin ..... E01D 19/125 14/73
4,135,335 A * 1/1979 Jensen ..... E04G 25/00 248/188.2

(Continued)

*Primary Examiner* — Phi D A

(74) *Attorney, Agent, or Firm* — Puget Patent; Michael Gibbons

(57) ABSTRACT

A system for diverting fluids consisting essentially of a wedge installed on a surface. The wedge is preferably triangular in area, but may be in the form of other shapes as required by the application. When viewed from the side, the wedge will often have a triangular shape because the front edge of the wedge is substantially lower than the rear edge, corner, or other shape to induce fluids and other materials to run off the sloped surface of the wedge. The system may include an adhesive to join the wedge and the surface. It may also include a sealing material disposed over the wedge and the surface to prevent incursion of fluids and other materials between the wedge and the surface.

17 Claims, 3 Drawing Sheets

(56) References Cited

U.S. PATENT DOCUMENTS 4,144,296 A * 3/1979 Dickens ..... B29C 44/12 264/45.4
4,193,150 A * 3/1980 Vineberg ..... A47C 20/027 297/DIG. 1
4,240,557 A * 12/1980 Dickens ..... A47B 96/021 108/901
4,304,318 A * 12/1981 Webb ..... E06C 7/44 182/107
4,526,641 A * 7/1985 Schriever ..... B29C 65/76 156/247
4,579,377 A * 4/1986 Dallaire ..... E05B 65/0894 156/293
4,776,548 A * 10/1988 Bezenek ..... B60T 3/00 248/188.2
4,830,320 A * 5/1989 Bellows ..... F16M 7/00 248/188.2
4,987,720 A * 1/1991 Wozney, Jr. ..... E04D 15/02 248/237
5,022,204 A * 6/1991 Anderson ..... E06B 1/62 49/504
5,119,904 A * 6/1992 Dierolf ..... E04D 13/12 182/230
5,217,269 A * 6/1993 Wiltberger ..... E05C 17/54 292/343
5,222,345 A * 6/1993 Riley ..... E06B 1/34 52/716.1
5,368,349 A * 11/1994 Hebert ..... E05C 17/54 16/82
5,492,298 A * 2/1996 Walker ..... G06F 3/0395 248/346.01
5,678,800 A * 10/1997 Markussen ..... G06F 3/0395 248/346.01
5,711,560 A * 1/1998 Gilbertson ..... E05C 17/54 292/343
5,853,838 A * 12/1998 Siems ..... E06B 1/6069 428/43
5,887,406 A * 3/1999 Bond ..... E04D 15/00 182/45
5,943,839 A * 8/1999 Miller ..... E04D 1/26 182/45
6,062,517 A * 5/2000 Torres ..... A47G 27/045 16/16
6,155,004 A * 12/2000 Earhart ..... E04F 13/0853 52/217
6,164,608 A * 12/2000 Schiel, Jr. ..... E06C 7/44 182/200
6,170,222 B1 * 1/2001 Miller ..... E04D 1/26 248/237
6,345,849 B1 * 2/2002 Yen ..... E05C 17/54 292/292
6,551,690 B2 * 4/2003 Dwinell ..... E06B 1/6069 428/156
6,553,995 B1 * 4/2003 Cole ..... A61F 5/01 128/846
6,648,284 B2 * 11/2003 Caporali ..... B07C 3/008 248/188.2
6,793,041 B1 * 9/2004 Taylor ..... E06C 7/44 182/121
D517,347 S * 3/2006 Hamilton ..... D16/242
7,014,229 B1 * 3/2006 Stelmach ..... E05C 17/44 292/342
7,108,234 B2 * 9/2006 Ritchey ..... A47B 21/0314 248/118.1
7,108,901 B2 * 9/2006 Traub ..... B29B 9/14 428/167
7,174,682 B2 * 2/2007 Pelosi, Jr. ..... E04F 11/002 14/69.5
7,716,880 B1 * 5/2010 Shray ..... B29C 44/583 248/188.2
7,784,751 B1 * 8/2010 Bellows ..... A47B 91/02 248/188.2
D653,104 S * 1/2012 Heyting ..... D8/403
8,166,722 B2 * 5/2012 Moller, Jr. ..... E04F 15/10 404/35
D667,565 S * 9/2012 Tsakiris ..... D25/102
8,448,746 B2 * 5/2013 Davis, Jr. ..... E04D 15/00 182/45
D691,147 S * 10/2013 Turvey ..... D14/447
D832,680 S * 11/2018 Bunch ..... D8/354
10,188,210 B2 * 1/2019 Gajowskyj ..... A47B 91/12
2009/0151067 A1 * 6/2009 Mathis ..... E04H 4/142 4/506
2012/0216474 A1 * 8/2012 Railkar ..... E04D 13/1475 52/302.6
2013/0047533 A1 * 2/2013 Diener ..... E04F 19/04 52/288.1

* cited by examiner

SYSTEMS AND METHODS FOR DIVERTING FLUIDS

FIELD OF THE INVENTION

This invention relates generally to construction, and, more specifically, to systems and methods for diverting fluids.

BACKGROUND OF THE INVENTION

Water and other liquids can collect on the edges of decks, porches, patios, roofs and other surfaces around buildings. When left in place, the liquids can cause molds, mildews, and rot, as well as creating a safety hazard for pedestrians. Due to surface tension, water tends to pool at points where an edge meets a wall, such as where the front edge of a balcony meets an adjoining wall. This is particularly so when the flat surface is treated with non-slip material, such as a textured polyurethane, which gives the water more surface area to which it clings. These are just some of the problems the invention disclosed herein aims to overcome.

BRIEF DESCRIPTION OF THE DRAWINGS

Certain embodiments of the present invention are described in detail below with reference to the following drawings.

DETAILED DESCRIPTION

This invention relates generally to construction, and, more specifically, to systems and methods for diverting fluids.

Specific details of certain embodiments of the invention are set forth in the following description and in FIGS. 1-4 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
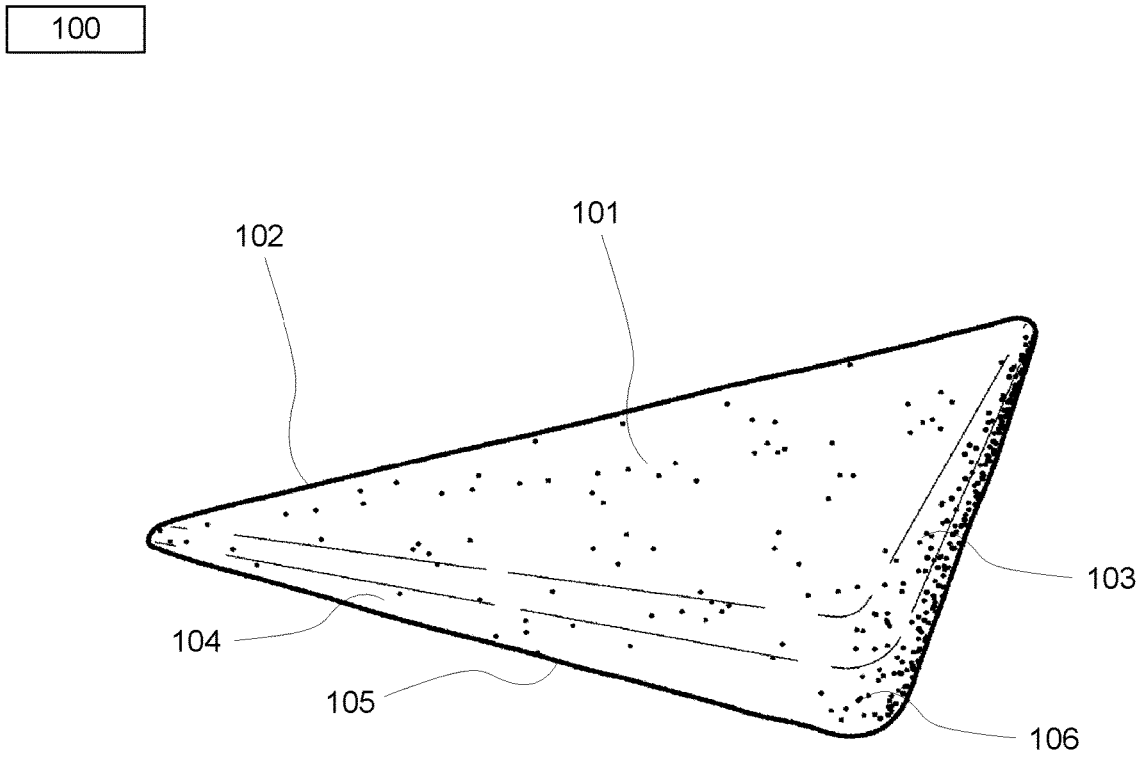
FIG. 1 is an isometric view of the system for diverting fluids.
Figure 2:
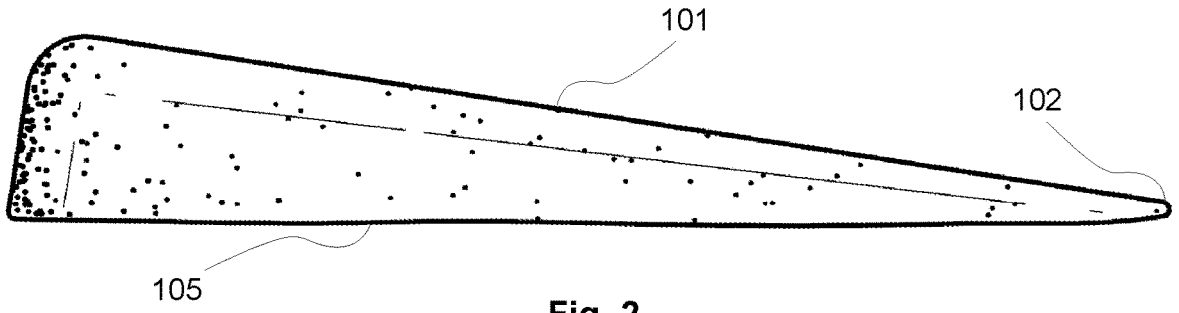
FIG. 2 is a side view thereof.

The system is comprised essentially of a wedge 100 as shown in FIG. 1. Wedge 100 is, in preferred embodiments, defined by a sloped face 101, lower edge 102, sides 103 and 104, and a substantially flat bottom 105. In some embodiments, wedge 100 may include corner 106. In other embodiments, corner 106 may not be necessary or desirable (see FIG. 3). When installed, wedge 100 creates a raised area by virtue of sloping sides 103 and 104 and the sloped face 101. See FIG. 2. This induces water and other materials to slide down wedge 100 and off by virtue of lower edge 102, which is substantially flush with the surface upon which wedge 100 is installed. In preferred embodiments, wedge may be comprised of a substantially waterproof or water-resistant material. In some embodiments, wedge 100 may be comprised of a urethane material, a polyurethane material, other plastics, rubbers, resins, etc. In preferred embodiments, wedge 100 may be comprised of a substantially rigid material, but one that still has some elasticity, such as urethane. In other embodiments, wedge 100 may be comprised of a material similar or identical to the surface upon which it is installed. For one non-limiting example, wedge 100 may be formed out of teak if it is to be installed on a teak deck. Wedge 100 may be installed by adhesive, weld, fasteners, or other means appropriate for joining the material of the wedge with the material upon which it is being installed. In some embodiments, wedge 100 may be placed upon the surface and then adhered thereto by use of a sealing material (see discussion of FIG. 4).

Figure 3:
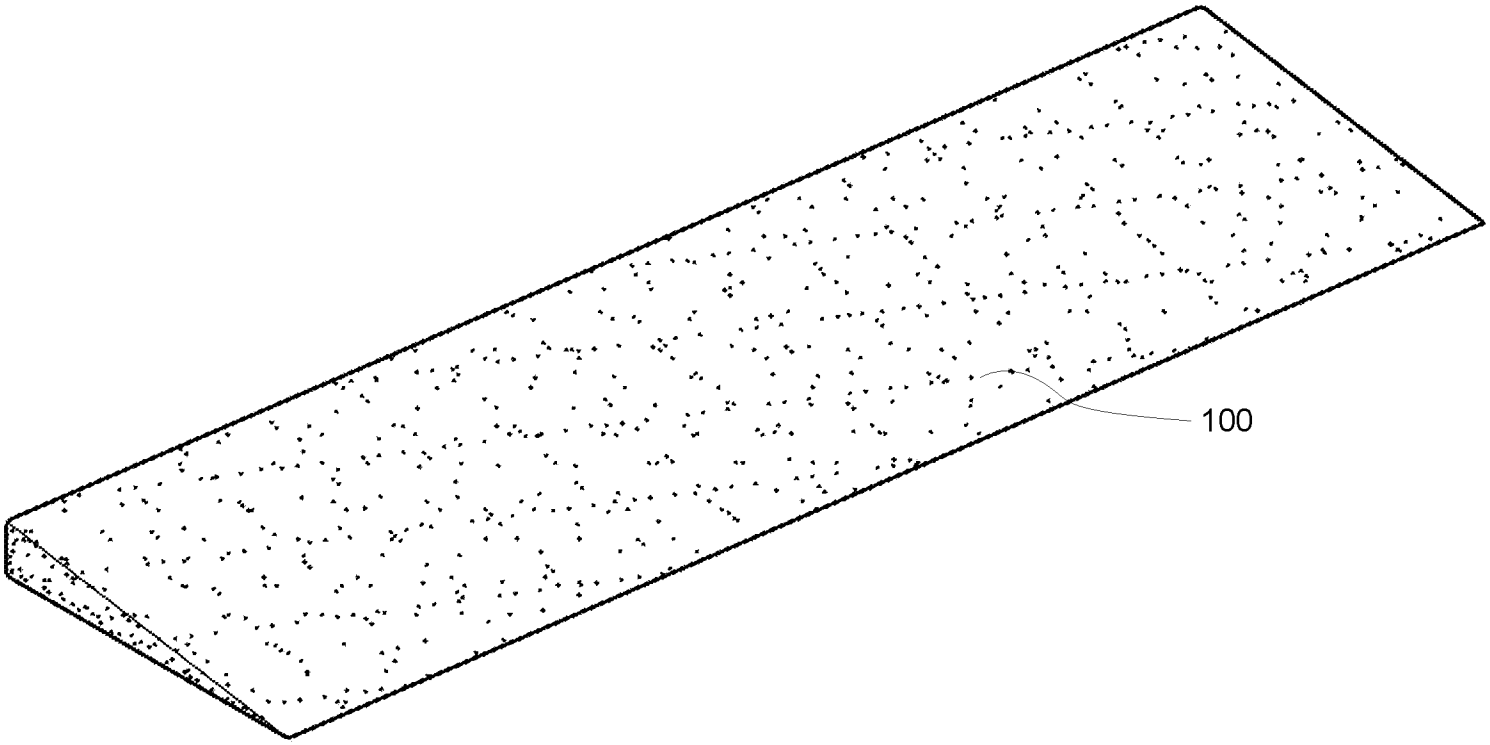
FIG. 3 is an isometric view of a different embodiment of the system for diverting fluids.

In some embodiments, wedge 100 may be substantially triangular in area. In other embodiments, wedge 100 may be a half-circle, a trapezoidal shape, or rectangular. In some embodiments, wedge 100 may be placed into a corner or a joint between a floor and a wall or post of a structure. Wedge 100 may be aligned along one side with the joint between the floor and the wall, and along another side with an edge or ledge of a deck, patio, balcony, roof, or other overhang. In some embodiments, wedge 100 may be aligned along a post or beam. In a further embodiment, the system may include a plurality of wedges configured to direct fluids away from multiple sides of a beam or a post. FIG. 3 shows wedge 100 in an elongated form, which would allow contractors to cut the wedge in the field for a precise fit.

Figure 4:
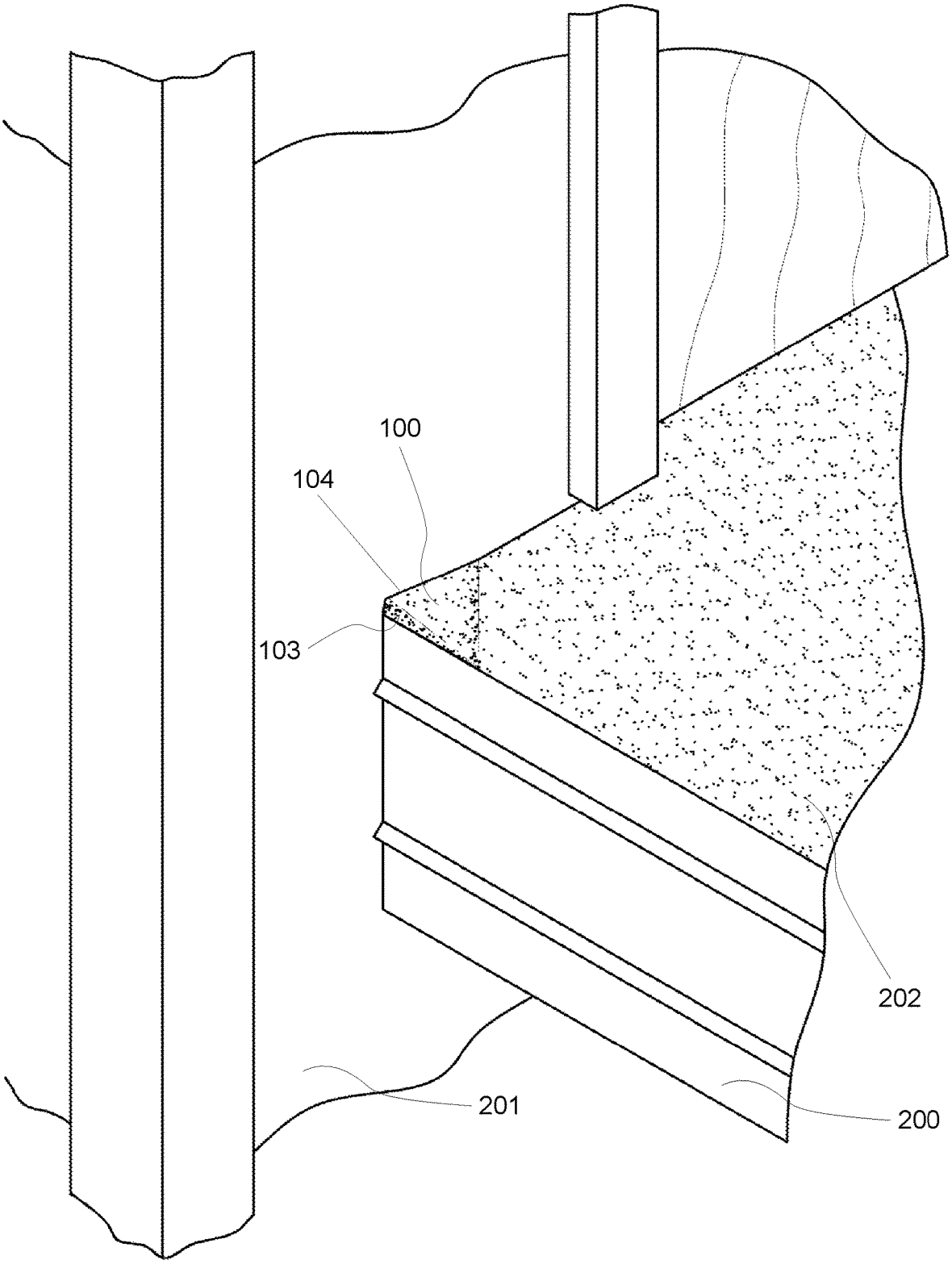
FIG. 4 is an environmental view of the system for diverting fluids as installed.

FIG. 4 shows the wedge 100 installed on a deck 200. This is one application of the system and should not be construed as limiting. Here, wedge 100 is installed where the deck 200 meets the wall 201, with side 104 abutting the wall and side 103 facing outward. This configuration allows fluids to run off wedge 100 and back onto the deck 200, where they are less likely to pool and cause rot or other problems. In some embodiments, wedge 100 may be used in combination with a sealing material 202. Sealing material 202 may be an adhesive, a texture coating, a waterproof coating, a weather-resistant material, a polymer concrete, cement, concrete, vinyl flooring material, stain, sealant, paint, or other material generally used in the construction of walking surfaces. One function of sealing material 202 may be to fix wedge 100 in place. Another function may be to provide a seamless surface, such that water and other materials cannot encroach between wedge 100 and the surface upon which it is installed. In some embodiments, the sealing material may be placed under wedge 100 and used as an adhesive to join wedge 100 with the floor or wall which it will be protecting. In some embodiments, the sealing material may be placed over wedge 100, such as with a polyurethane or urethane coating on a deck, a boat deck, or a truck bed. In some embodiments, the sealing material may be placed both over and under wedge 100, protecting the construction from fluid incursion in multiple layers.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system for diverting fluids, consisting of:

a wedge, consisting of:

a triangular bottom, the triangular bottom defined by a first side and a second side joined at a corner, and by a lower edge opposing the corner; and a triangular sloped face disposed above the triangular bottom, the triangular sloped face defined by the first side and the second side joined at the corner, wherein the lower edge opposing the corner is a straight line, and by the lower edge opposing the corner, wherein a slope of the triangular sloped face descends from a top portion of the first side and from a top portion of the second side to the lower edge, a highest point of the triangular sloped face disposed at the corner, wherein a plane through the triangular bottom meets a plane through the triangular sloped face at the lower edge opposing the corner such that there is no height difference between the triangular bottom and the triangular sloped face at the lower edge, and wherein a volume between the triangular bottom and the triangular sloped face is solid; and at least some sealing material disposed over the wedge such that the triangular sloped face is covered by the at least some sealing material, the at least some sealing material extending past a perimeter established by the lower edge and configured to be coupled with a substantially flat surface upon which the wedge is installed.

2. The system for diverting fluids of claim 1, wherein the triangular sloped face of the wedge is substantially triangular in area.

3. The system for diverting fluids of claim 1, wherein the first side of the wedge and the second side of the wedge are substantially triangular in area.

4. A system for diverting fluids, comprising:

a wedge, consisting of:

a triangular bottom, the triangular bottom defined by a first side and a second side joined at a corner, and by a lower edge opposing the corner; and a triangular sloped face disposed above the triangular bottom, the triangular sloped face defined by the first side and the second side joined at the corner, wherein the lower edge opposing the corner is a straight line, and by the lower edge opposing the corner, wherein a slope of the triangular sloped face descends from a top portion of the first side and from a top portion of the second side to the lower edge, a highest point of the triangular sloped face disposed at the corner, wherein a plane through the triangular bottom meets a plane through the triangular sloped face at the lower edge opposing the corner such that there is no height difference between the triangular bottom and the triangular sloped face at the lower edge, and wherein a volume between the triangular bottom and the triangular sloped face is solid; and at least some sealing material disposed over the wedge such that the triangular sloped face is covered by the at least some sealing material, the at least some sealing material extending past a perimeter established by the lower edge and configured to be coupled with a substantially flat surface upon which the wedge is installed.

5. The system for diverting fluids of claim 4, wherein the at least some sealing material comprises at least some texture material configured to provide a non-slip surface.

6. The system for diverting fluids of claim 4, wherein the wedge and the at least some sealing material are configured to be permanently installed on the substantially flat surface.

7. The system for diverting fluids of claim 1, wherein the triangular sloped face of the wedge comprises a planar slope.

8. The system for diverting fluids of claim 1, wherein at least one of the first side of the wedge or the second side of the wedge are configured to abut a wall.

9. The system for diverting fluids of claim 1, wherein the wedge is configured to be permanently installed on a substantially flat surface.

10. The system for diverting fluids of claim 1, wherein the wedge is configured to facilitate flow of fluids away from the first side of the wedge and away from the second side of the wedge upon the wedge being installed on a substantially flat surface.

11. The system for diverting fluids of claim 1, wherein the wedge is a volume having only four faces, each of the four faces defined by a triangular shape.

12. The system for diverting fluids of claim 11, wherein the four faces include the triangular bottom, the triangular sloped face, the first side, and the second side.

13. The system for diverting fluids of claim 1, wherein the triangular bottom of the wedge and the triangular sloped face of the wedge are right triangles in shape.

14. The system for diverting fluids of claim 1, wherein the triangular bottom of the wedge and the triangular sloped face of the wedge are isosceles right triangles in shape.

15. The system for diverting fluids of claim 1, wherein the wedge is configured for being placed into a corner.

16. The system for diverting fluids of claim 15, wherein the wedge is configured for the first side of the wedge to abut a first wall and configured for the second side of the wedge to abut a second wall, the corner of the wedge adjacent to a corner formed by a joint between the first wall and the second wall.

17. The system for diverting fluids of claim 1, wherein the wedge is configured for at least one of the first side of the wedge or the second side of the wedge to abut a wall and for an opposing side of the at least one of the first side of the wedge or the second side of the wedge to be aligned flush with an edge.

* * * * *